US006435927B1

(12) United States Patent
Fireman

(10) Patent No.: US 6,435,927 B1
(45) Date of Patent: Aug. 20, 2002

(54) RECREATIONAL FLOATING DEVICE HAVING UNDERWATER PROJECTILE DISPENSING FEATURE

(75) Inventor: Andrew F. Fireman, North Bethesda, MD (US)

(73) Assignee: Riva Sports, Inc., Rockville, MD (US)

( * ) Notice: Subject to any disclaimer, the term of this patent is extended or adjusted under 35 U.S.C. 154(b) by 0 days.

(21) Appl. No.: 09/799,398

(22) Filed: Mar. 5, 2001

(51) Int. Cl.[7] ..... B63B 1/00
(52) U.S. Cl. ..... 441/65; 472/129
(58) Field of Search ..... 441/65, 129; 114/267, 114/255, 347; 472/128, 129; 473/417, 418, 419, 466, 352

(56) References Cited

U.S. PATENT DOCUMENTS 3,592,468 A * 7/1971 Simendinger, Jr. ..... 114/346
4,723,329 A * 2/1988 Vaccaro ..... 441/129
4,932,912 A * 6/1990 Combs ..... 222/78
5,236,148 A * 8/1993 Valentine ..... 16/DIG. 13
5,325,806 A * 7/1994 Lee ..... 114/345
6,022,024 A * 2/2000 Kahn ..... 273/317

* cited by examiner

*Primary Examiner*—Stephen Avila
(74) *Attorney, Agent, or Firm*—Steven N. Fox, Esq.

(57) ABSTRACT

The present invention is a recreational floating device for use by a person in water such as a swimming pool. The device comprises a board member adapted to float on the water. The board member comprises an upper surface and a bottom surface. The bottom surface is in contact with the water. The device further comprises a projectile retention member engaged with the board member and a projectile member retained by the projectile retention member. The device further comprises a projectile trigger member engaged with the projectile retention member and operable by the person to dispense the projectile member thru the water. In another embodiment, the device further comprises a projectile viewing member that allows the person to view the projectile member after firing or dispensing.

21 Claims, 7 Drawing Sheets

RECREATIONAL FLOATING DEVICE HAVING UNDERWATER PROJECTILE DISPENSING FEATURE

FIELD OF THE INVENTION

The present invention relates to recreational devices. More particularly, the present invention relates to a recreational devices for use by a person in a water environment such as a swimming pool.

BACKGROUND OF THE INVENTION

Many recreational articles have been developed to provide amusement and fun for people who enjoy water activities. Well known recreational articles include surfboards, inner tubes, and kickboards. U.S. Pat. No. 4,932,912 discloses a kickboard having a manually operated toy gun for directing a stream of water toward a desired target.

SUMMARY OF THE INVENTION

One object of the present invention was to develop a recreational device for use by a person in the water that was fun and easily operated by a child or an adult, and safe.

The present invention is a recreational floating device for use by a person in water such as a swimming pool. The device is generally adapted to allow the person to actuate a trigger to dispense, launch, fire, and/or drop a toy projectile thru the water. By way of example only, the device may be used to allow the person to dispense a projectile thru the water to hit or make contact with a target disposed upon the bottom surface of a swimming pool. In one embodiment, the device comprises a board member adapted to float on the water. The board member comprises an upper surface and a bottom surface. The bottom surface is in contact with the water. The device further comprises a projectile retention member engaged with the board member and a projectile member retained by the projectile retention member. The device further comprises a projectile trigger member engaged with the projectile retention member and operable by the person to dispense the projectile member thru the water. In another embodiment, the device may comprise a projectile viewing member that allows the person to view the path of the projectile member after dispensing.

BRIEF DESCRIPTION OF THE DRAWINGS

The following detailed description of the invention will be more fully understood with reference to the accompanying drawings in which.

DETAILED DESCRIPTION OF THE PREFERRED EMBODIMENTS

Figure 1:
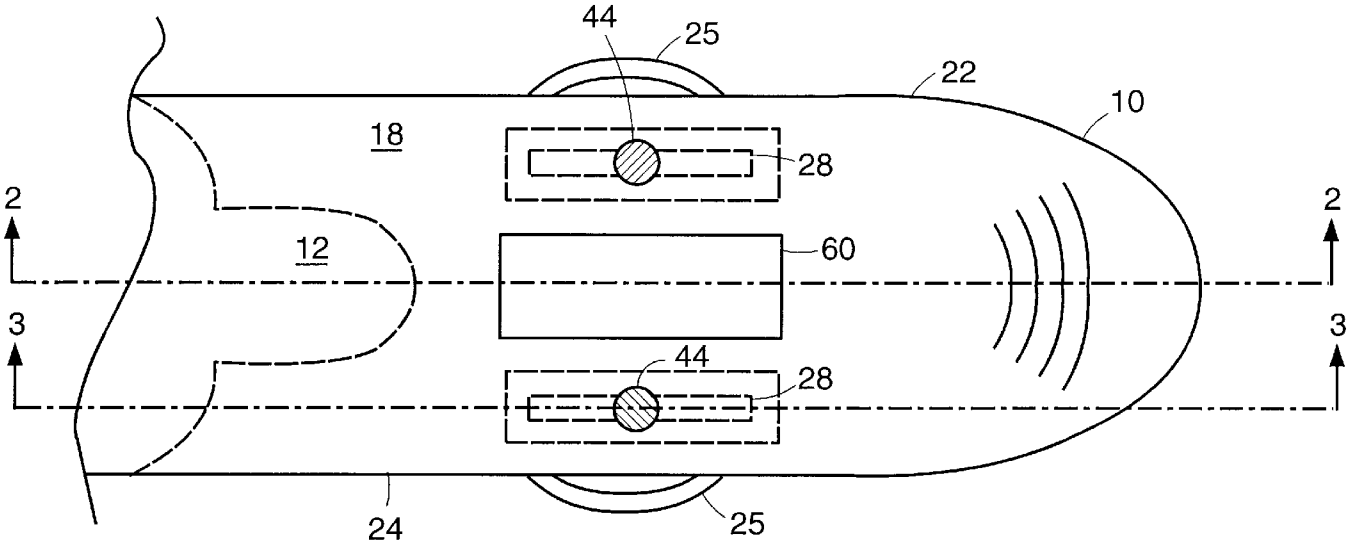
FIG. 1 is a top plan view of a first embodiment of the present invention.
Figure 3:
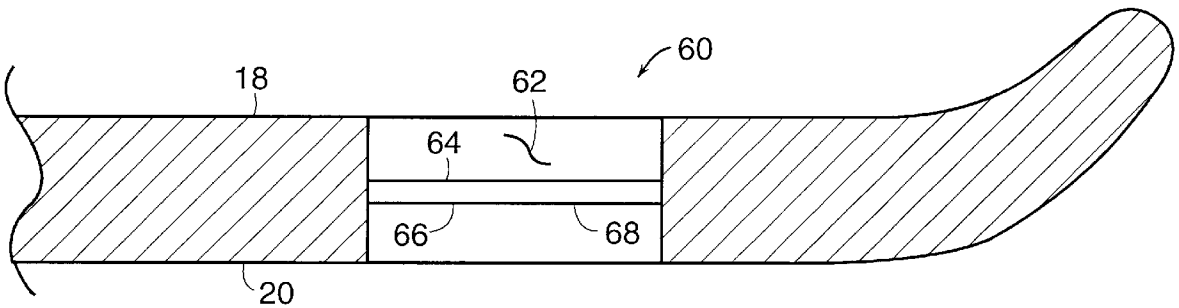
FIG. 3 is cross sectional view taken along line 3—3 of FIG. 1.
Figure 2:
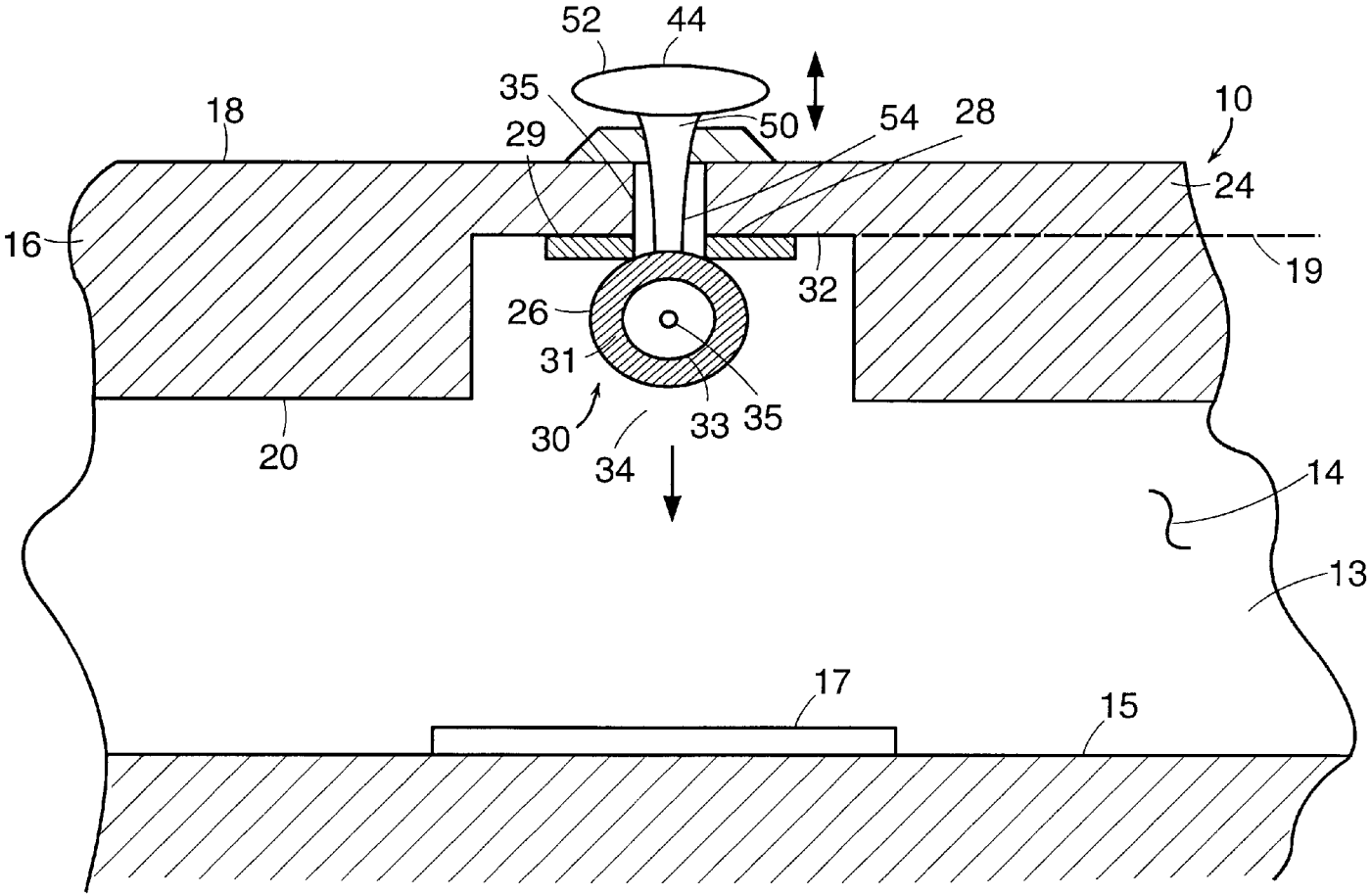
FIG. 2 is cross sectional view taken along line 2—2 of FIG. 1.

Referring to FIGS. 1–2, where a first embodiment of the recreational floating device 10 is shown for use by a person 12 in a body of water 14 such as a pool 13 having a bottom surface 15. The device 10 is generally adapted to allow the person 12 to float on the water 14 and to actuate a trigger or lever to dispense, launch and/or drop a projectile thru the water 14. By way of example only, the device 10 may be used to allow the person 12 to dispense a projectile thru the water 14 to hit or make contact with a target 17 disposed upon the bottom surface 15 of the pool 13.

The device 10 generally comprises a board member 16 adapted. to allow the person 12 to float on the water 14. In the embodiment shown, the board member 16 comprises an upper surface 18 and a bottom surface 20, and first and side portions 22 and 24. The bottom surface 20 is in contact with the water 14. Depending upon the weight of the person 12 and/or the buoyancy of the board member 16, the water line 19 may extend anywhere from half-way to just below the upper surface 18 of the board member 16. The board member 16 may be designed and manufactured with variety of materials, sizes, and configuration to allow different persons 12 using the device 10 to float on the water 14. By way of example only, the board member 16 may be made from compressed foam or a hollow plastic material fabricated by injection and/or blow molding processes.

The device 10 further comprises a projectile retention member 28 engaged with the board member 16. The projectile retention member 28 is generally adapted to retain a projectile member 26 (to be described) until the person 12 actuates a projectile trigger member 44 (to be described) to dispense, launch and/or otherwise drop the projectile member 26. The projectile retention member 28 may take a variety of different forms and designs. In the embodiment shown, the projectile retention member 28 comprises a fastener such as strip and/or a layer of velcro 29 engaged with the board memberl6 and located between the upper and bottom surfaces 18 and 20 of the board member 16. The velcro fastener 29 is adapted to be removably engaged with the projectile member 26 by activation of the projectile trigger member 44. The projectile retention member 28 may further comprise a cavity portion 30 having a closed end portion 32 and an open end portion 36 directed at the water. The cavity portion 30 may be positioned and designed in a variety of different ways and may be formed as part of the molding process.

The projectile member 26 is adapted to be retained by the projectile retention member 28 until after actuation of the projectile trigger member 44. The projectile member 26 may be designed in a variety of different shapes and forms. In the embodiment shown, the projectile member 26 is in the shape of a ball 27. The ball 27 comprises an outer fastening layer of velcro 31 and adapted to releaseably engage with the velcro fastener 29 of the projectile retention member 28. The ball 27 may comprise one or more weights 33 within a molded cavity 35 to control the buoyancy of the projectile member 26 so that it will drop smoothly thru the water 14 to the target 17 at the bottom surface 15 of the pool 13. By way of further example only, the projectile member 26 may take the form and design of the elongated projectiles disclosed and described by U.S. Pat. No. 5,514,023 which are designed to have a projectile buoyancy within plus or minus ten percent (10%) of the water to allow the projectile to move in a substantially straight line parallel with the bottom surface of the pool. In other embodiments, the projectile member 26 may be designed with a positive buoyancy so that after dispensing the projectile member 26 would float to the top of the water.

The projectile trigger member 44 is generally engageable with the projectile retention member 28 and operable by the person 12 to dispense, drop, and/or launch the projectile member 26 thru the water 12. The projectile trigger member 44 is operable by the person 12 from a first or closed position 56 where the projectile member 26 is retained by the projectile retention member 28 to a second or open (released) position 58 where the projectile member 26 is dispensed from the projectile retention member 28 thru the water 14. The projectile trigger member 44 may be designed in a variety of different shapes and forms and located in various areas of the board member 16. For example, the projectile trigger member 44 may be positioned near the handles 25 of the board member 16 to allow easy access by the person 12 while the person 12 is holding on to the board member 16. In the embodiment shown, the projectile trigger member 44 comprises a lever member 50 having a handle portion 52 and an engagement portion 54. The lever member 50 is operable by the person from the first position 56 where the projectile member 26 is retained by the projectile retention member 28 to the second or open (released) position 58 where the projectile member 26 is dispensed from the projectile retention member 26 thru the water 12 and the engagement portion 54 extends thru an opening or thru-hole 55 extending from the upper surface 18 of the board member 16 to the closed end portion 32 of the cavity portion 30. In the embodiment shown, the handle portion 52 is disposed above the upper surface 18 of the board member 16. In other embodiments, the. handle portion 52 may be disposed between the upper and bottom surfaces 18 and 20 of the board member 16 or as in the embodiment of FIGS. 9–12 (to be described), disposed along the side surfaces 22 and 24 of the board member 16. The lever member 14 may be made from a variety of different materials and formed by a variety of different processes. In the embodiment shown, the lever member 44 may be made from plastic by conventional molding processes.

The device 10 may further comprise a projectile viewing member 60 adapted to allow the person 12 to view dispensing of the projectile member 26 thru the water 12. In the embodiment shown, the projectile viewing member 60 generally comprises an opening 62 extending from the upper surface 18 to the bottom surface 20 of the board member 16. The projectile viewing member 60 may further comprise a transparent viewing member 64 disposed within the opening 62. The transparent viewing member 64 may comprise a first portion 66 and a second portion 68. The transparent viewing member 64 may be designed in a variety of ways and made from variety of materials. By way of example only, the transparent viewing member 64 may be made from thin plastic that simply allows the person 12 to see thru the viewing member 64. In other embodiments, the first portion 66 and/or the second portion 68 of the transparent viewing member 64 may be angled to provide downward and/or forward viewing areas. In other embodiments, the transparent viewing member 64 and/or first portion 66 and/or the second portion 68 may comprise a lense to enhance the viewing areas. The transparent viewing member 64 may further comprise a sight member or film (not shown) to be used for alignment by the person 12.

Figure 4:
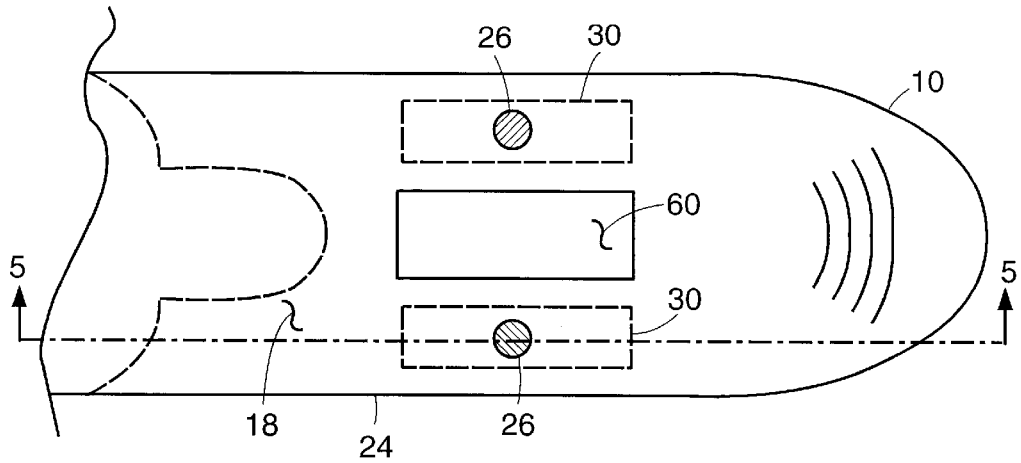
FIG. 4 is a top plan view of a second embodiment of the present invention.
Figure 5:
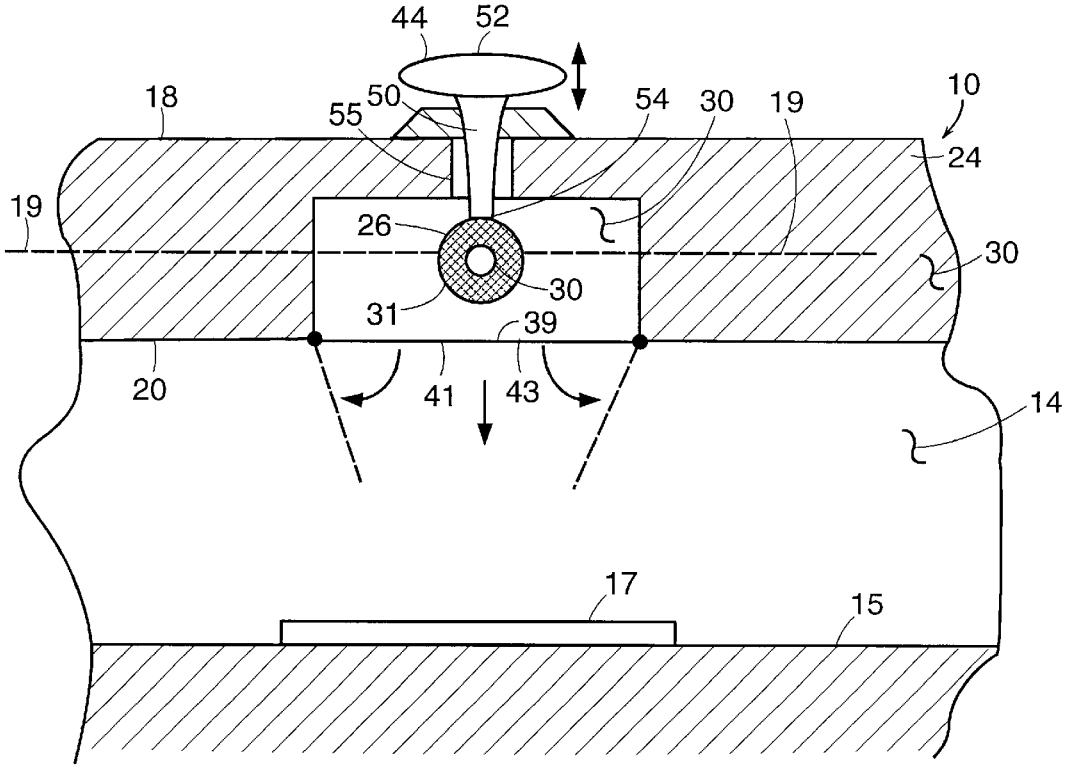
FIG. 5 is a cross-section view taken along line 5—5 of FIG. 4.

Referring to FIGS. 4 and 5, where in another embodiment of the device 10, the projectile retention member 28 comprises the cavity portion 30 and a closure member 39. The closure member 39 may comprise first and second flaps or doors 41 and 43 that rotate outward as a force is applied to the projectile member 26 by actuation of the projectile trigger member 44. The flaps 41 and 43 may be connected by conventional means such as hinges formed as part of and/or connected to the board member 18 and/or flaps 41 and 43. In the embodiment shown, the projectile member 26 is retained within the projectile retention member 28 until actuation of the projectile trigger member 44.

Figure 6:
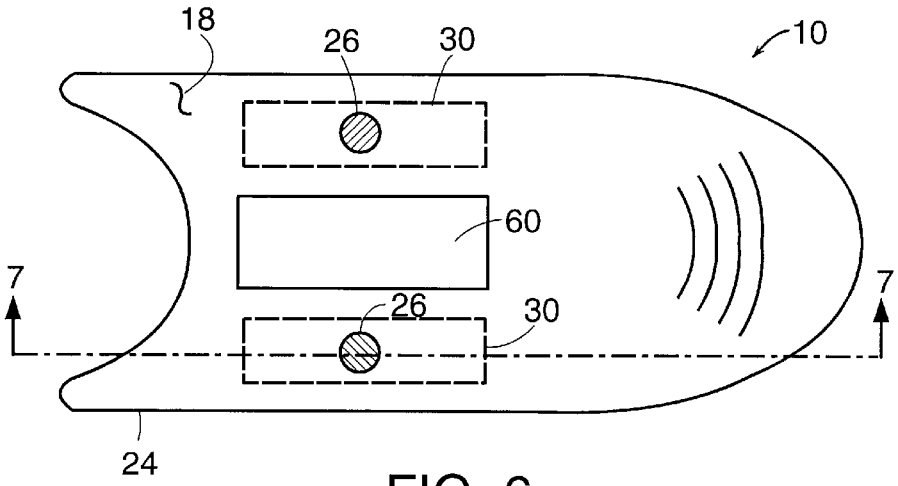
FIG. 6 is a top plan view of a third embodiment of the present invention.
Figure 7:
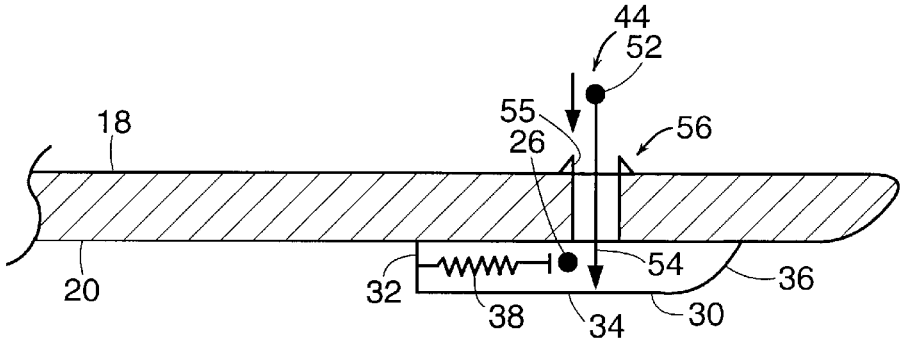
FIGS. 7 and 8 are cross sectional views taken along line 7—7 of FIG. 6.
Figure 8:
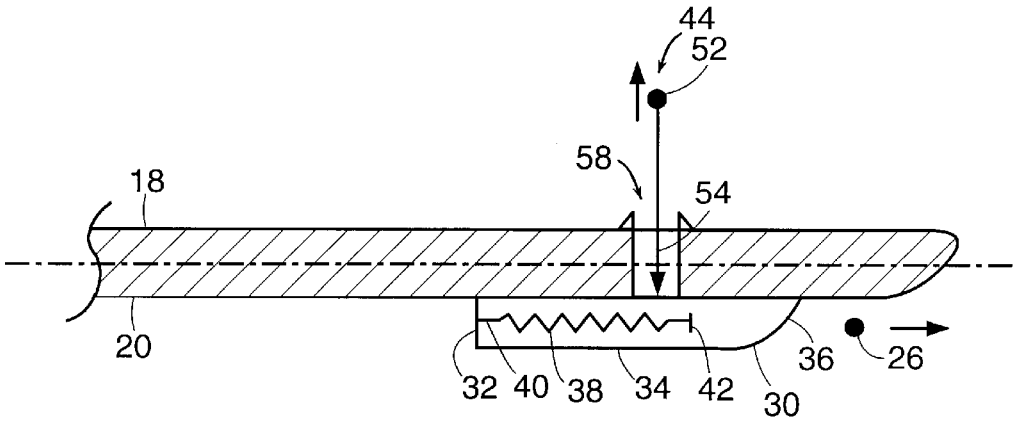
Figure 9:
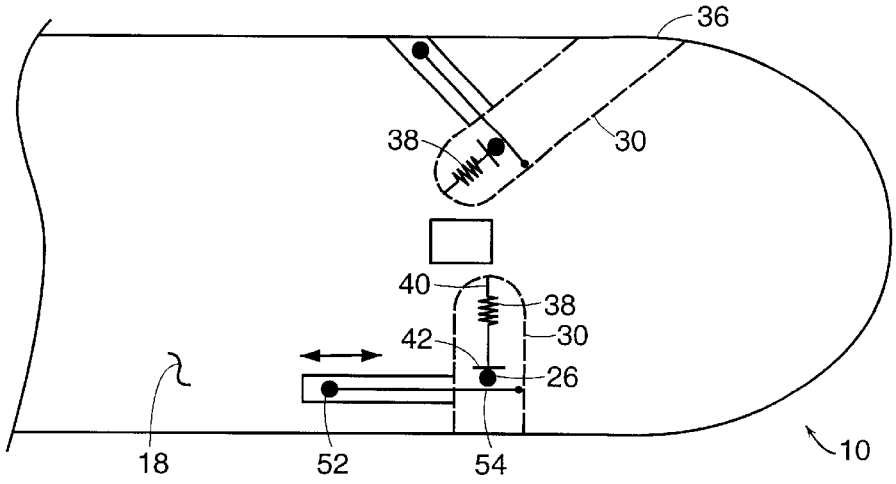
FIG. 9 is a top plan view of a fourth embodiment of the present invention showing the projectile member retained within the cavity portion.
Figure 10:
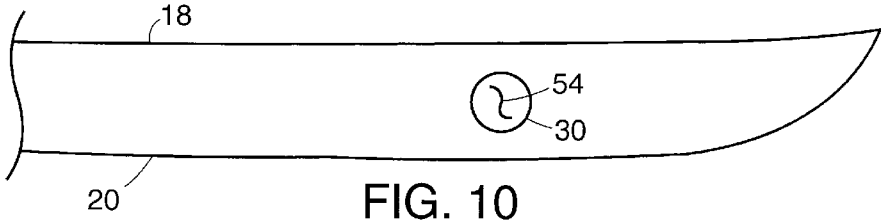
FIG. 10 is a side elevation view of the fourth embodiment of the present invention showing the projectile member retained within the cavity portion.
Figure 11:
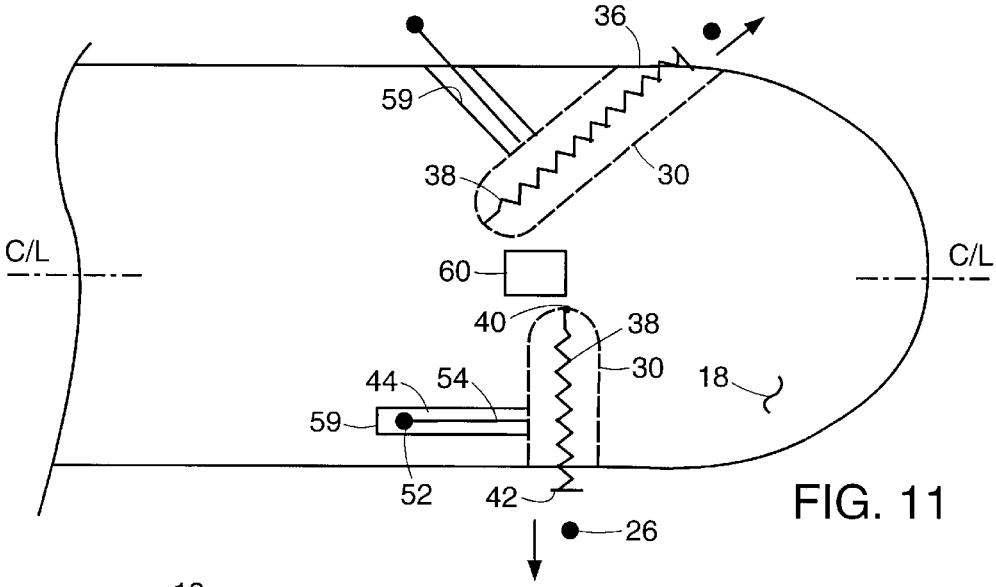
FIG. 11 is a top plan view of the fourth embodiment of the present invention showing the projected dispensed from the cavity portion.
Figure 12:
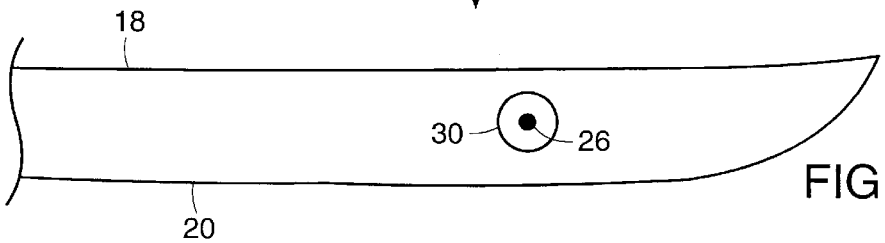
FIG. 12 is a side elevation view of the fourth embodiment of the present invention showing the projectile dispensed from the cavity portion.

Referring to FIGS. 6, 7 and 8, where another embodiment of the device 10. In this embodiment, the cavity portion 30 is disposed below the bottom surface 20 of the board member 16 and the open end portion 36 is directed forward of the board member 16. In this embodiment, the projectile retention member 28 may further comprise a spring member 38 having a first portion 40 engaged with the closed end portion 32 and a second portion 42 engageable with the projectile member 26. The lever member 50 is moveable from the first or closed position 56 where the engagement portion 54 extends into the median portion 34 of the cavity portion 30 to retain the projectile member 26 which is being forward biased by the spring member 38 against the engagement portion 54 to a second position 58 wherein the engagement portion 54 is withdrawn from the cavity portion 30 and the projectile retention member 28 is dispensed outward by the force of the spring member 38.

Referring to FIGS. 9–12, where another embodiment of the device 10. In this embodiment, the cavity portion 30 is disposed between the upper and bottom surfaces 18 and 20 of the board member 16 or internal of the board member 16. Similar to the embodiment of FIGS. 6, 7, and 8, the lever member 50 is moveable from a first or closed position 56 where the engagement portion 54 extends into the median portion 34 of the cavity portion 30 to retain the projectile member 26 which is being forward biased by the spring member 38 against the engagement portion 54 to a second position 58 wherein the engagement portion 54 is withdrawn from the cavity portion 30 and the projectile retention member 28 is dispensed outward by the force of the spring member 38. In this embodiment, one of the cavity portions 30 is off-set from the centerline of the board member 16 and the open end portion 36 of the cavity portion 30 would direct dispensing of the projectile member 26 to the side and forward of the board member 16. The lever member 50 may be disposed with a channel or cavity portion 59.

Figure 13:
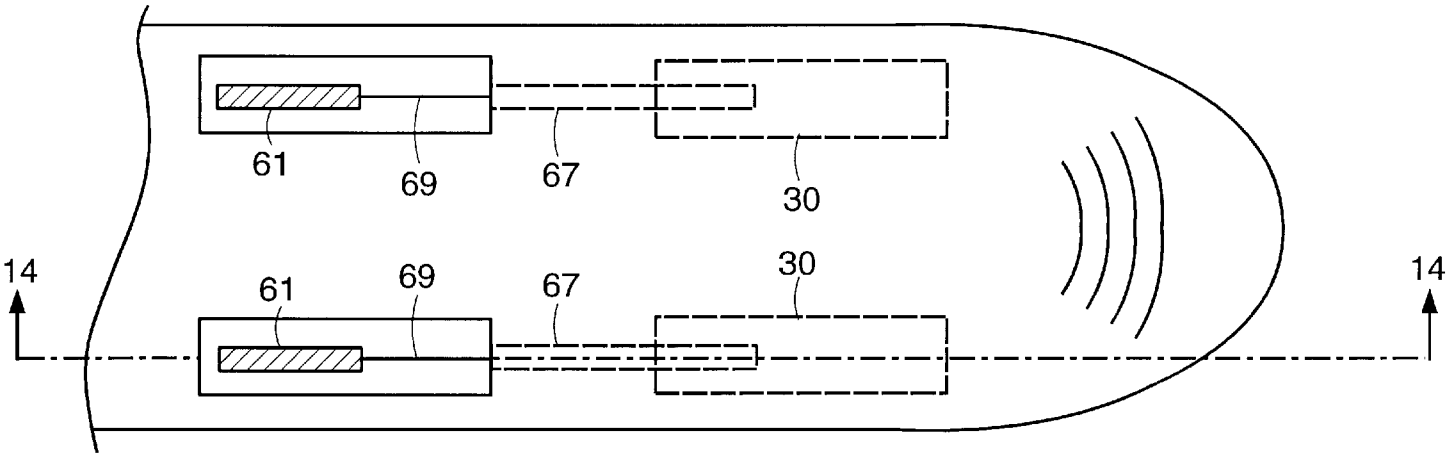
FIG. 13 is a top plan view of a fifth embodiment of the present invention.
Figure 14:
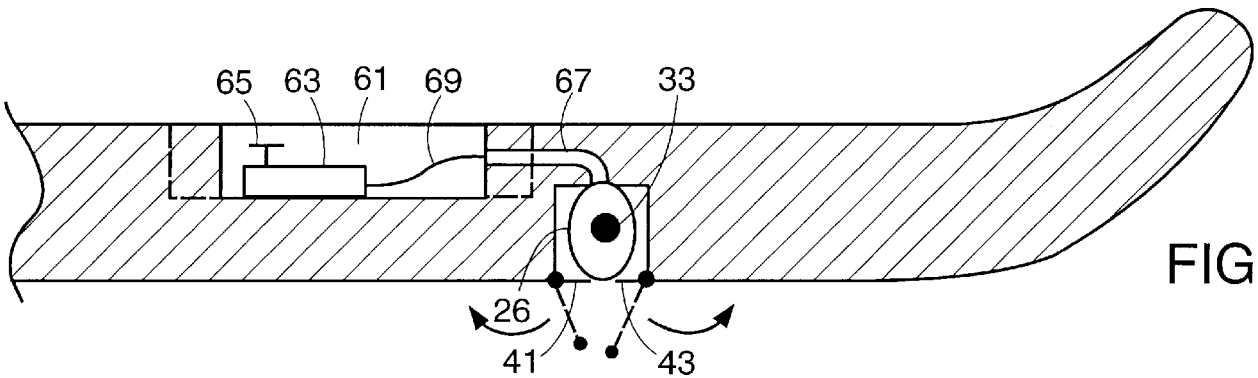
FIG. 14 is a cross sectional view taken along line 14—14 of FIG. 13.

Referring to FIGS. 13 and 14, where in another embodiment of the present invention, the projectile trigger member 44 may utilize a compressed air tank system 61. In the embodiment shown, the compressed air system 61 generally comprises compressed air tank 63, an off/on button 65, an air line 69 connected to an air channel or line 67. Actuation of the button 65 causes compressed air to flow through the air channel 67 and to force the projectile member 26 out of the cavity portion 30 thru the flaps 41 and 43. The air line or channel 67 may comprise one or more conventional pliable air lines passing thru one or more channels formed as part of the board member 16.

Figure 15:
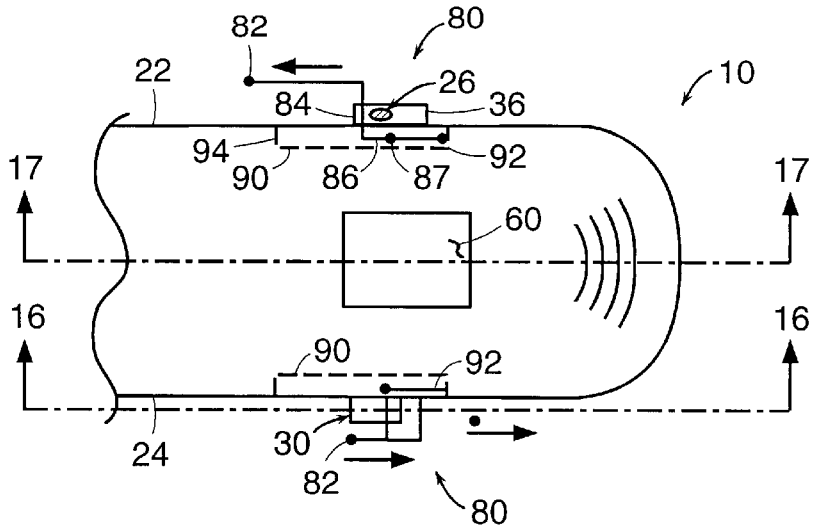
FIG. 15 is a top plan view of a sixth embodiment of the present invention.
Figure 16:
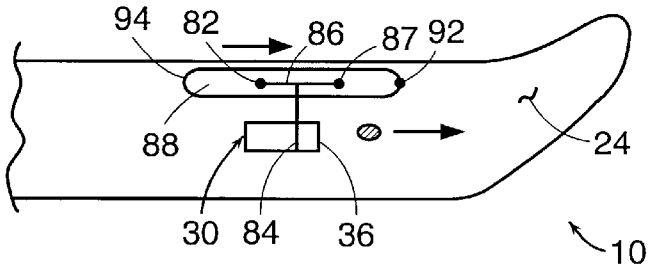
FIG. 16 is a cross sectional view taken along line 16—16 of FIG. 15.
Figure 17:
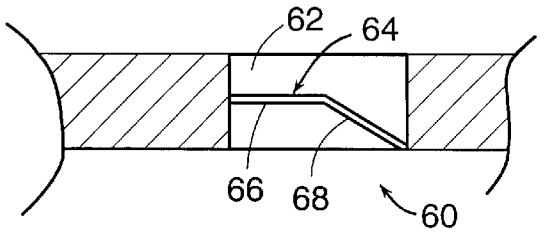
FIG. 17 is a cross sectional view taken along line 17—17 of FIG. 15.

Referring to FIGS. 15, 16, and 17, where in another embodiment of the present invention, the projectile trigger member 44 comprises a lever member 80 having a hand grip 82, an engagement portion 84, a bearing portion 86, and an end portion 87. The bearing portion 86 rides or is moveable within a cavity or channel portion 90 disposed within and exposed from the side portions 22 and 24 of the board member 16. The channel portion has a first end 92 and a second end portion 94. The projectile trigger member 44 further comprises an elastic band 96 connected to the end portion 87 of the lever member 80 and to the first end of the channel 90. The lever member 80 is moveable within the channel 90 from a first position 98 where the elastic member is stretched or biased to a second position 100 where the lever member 80 is released by the person 12 and the force from the elastic member 96 causes the engagement portion 84 to dispense the projectile member 26 from the cavity portion 30 thru the open end portion 36.

The foregoing description is intended primarily for purposes of illustration. This invention may be embodied in other forms or carried out in other ways without departing from the spirit or scope of the invention. Modifications and variations still falling within the spirit or the scope of the invention will be readily apparent to those of skill in the art.

What is claimed is:

1. A recreational floating device for use by a person in water comprising:

(a) a board member adapted to float on the water, said board member having an upper surface and a bottom surface, said bottom surface being in contact with the water;

(b) a projectile retention member engaged with said bottom surface of said board member;

(c) a projectile member retained by said projectile retention member; and (d) a projectile trigger member engageable with said projectile retention member and operable by the person from a first position where said projectile member is retained by said projectile retention member to a second position where said projectile member is dispensed from said projectile retention member to the water.

2. The device of claim 1, further comprising a projectile viewing member adapted to allow the person to view dispensing of said projectile through the water.

3. The device of claim 2, wherein said projectile viewing member comprises an opening extending from said upper surface to said bottom surface of said board member.

4. The device of claims 3, wherein said projectile viewing member further comprises a transparent viewing member disposed within said opening, said transparent viewing member having first and second portions.

5. The device of claim 4, wherein said first portion of said transparent viewing member is angled relative to said second portion to provide viewing of the water.

6. A recreational floating device for use by a person in water comprising: a board member adapted to float on the water, said board member having an upper surface and a bottom surface and first and second side portions, said bottom surface being in contact with the water; a projectile retention member engaged with said board member; a projectile member retained by said projectile retention member; said projectile retention member comprises a cavity portion adapted to retain said projectile member; said cavity portion comprises a closed end portion, a median portion, and an open end portion directed at the water; a projectile trigger member engageable with said projectile retention member; said projectile trigger member is operable by the person from a first position where said projectile member is retained by said projectile retention member to a second position where said projectile member is dispensed from said projectile retention member.

7. The device of claim 6, wherein said cavity portion is disposed between said top surface and second bottom surface of said board member.

8. The device of claim 7, wherein said cavity portion extends to said bottom surface of said board member.

9. The device of claim 6, wherein said projectile trigger member comprises a lever member operable by the person from a first position where said projectile is retained by said projectile retention member to a second position where said projected is dispensed from said projectile retention member through the water.

10. The device of claim 9, wherein said lever member comprises a handle portion and an engagement portion.

11. The device of claim 10, where said handle portion is operable by the person from a first position where said engagement portion is disposed within said cavity portion to retain said projectile member to a second position where said engagement portion is disengaged from said cavity portion to dispense said projectile member.

12. The device of claim 11, wherein said handle portion is disposed above the upper surface of said board member.

13. The device of claim 11, wherein said handle portion is disposed along said first side portion of said board member.

14. The device of claim 11, wherein said projectile trigger member further comprises a spring member having a first portion engaged with said inner end portion and a second portion engageable with said projectile member in said first position of said lever member where said projectile is retained by said projectile retention member and being adapted to urge said projectile outward from said open end of said cavity portion in said second position of said lever member where said projectile member is dispensed from said projectile retention member.

15. The device of claim 6, further comprising a projectile viewing member adapted to allow the person to view dispensing of said projectile through the water.

16. The device of claim 15, wherein said projectile viewing member comprises an opening extending from said upper surface to said bottom surface of said board member.

17. The device of claim 16, wherein said projectile viewing member further comprises a transparent viewing member disposed within said opening, said transparent viewing member having first and second portions.

18. The device of claim 17, wherein said first portion of said transparent viewing member is angled relative to said second portion to provide viewing of the water.

19. The device of claim 18, wherein said transparent viewing member is made from plastic.

20. The device of claim 6, wherein said board member is elongated and said projectile member is in the form of a ball.

21. The device of claim 20, wherein said projectile member has a buoyancy less than the water.

* * * * *